US006126127A

United States Patent [19]

Riblet

[11] Patent Number: 6,126,127

[45] **Date of Patent: *Oct. 3, 2000**

[54] BRACKET ASSEMBLY

[75] Inventor: Henry J. Riblet, Melvin Village, N.H.

[73] Assignee: Redev Management Corporation, Melvin Village, N.H.

[ * ] Notice: This patent is subject to a terminal disclaimer.

[21] Appl. No.: 09/173,356

[22] Filed: Oct. 15, 1998

[51] Int. Cl.[7] ..... E04G 3/00

[52] U.S. Cl. ..... 248/219.4; 248/246; 248/248

[58] Field of Search ..... 248/219.4, 300, 248/248, 247, 240, 235, 240.3, 246; 211/135, 193

[56] References Cited

U.S. PATENT DOCUMENTS

| | | | |
|---|---|---|---|
| 1,083,763 | 1/1914 | Smedberg | 248/248 |
| 1,224,016 | 4/1917 | Petersen | 248/235 |
| 2,244,374 | 6/1941 | Riblet | 182/146 |
| 2,342,427 | 2/1944 | Riblet | 304/30 |
| 2,605,074 | 7/1952 | Bucsko | 248/235 |
| 2,854,293 | 9/1958 | Riblet | 304/30 |
| 3,193,233 | 7/1965 | Wichser | 248/240.3 |
| 3,473,774 | 10/1969 | Riblet | 248/246 |
| 3,970,277 | 7/1976 | Riblet | 248/246 |
| 4,360,181 | 11/1982 | Burkholder | 248/248 |
| 4,452,336 | 6/1984 | Sickler | 248/216.1 |
| 5,257,766 | 11/1993 | Riblet | 248/248 |

*Primary Examiner*—Anita M. King
*Attorney, Agent, or Firm*—Kriegsman & Kriegsman

[57] ABSTRACT

A bracket assembly includes an angle bracket which may be formed from a single-piece metal blank which can be shaped and bent to define in its load-bearing form a substantially triangular bracket having a horizontal leg and a diagonal leg as well as a vertical support which may be similar to the horizontal leg. Each of the legs have a pair of upstanding sidewalls which extend normally from an associated base to form a substantially U-shaped cross-section. The diagonal and horizontal legs are contiguous and are connected by a first bendable section to define a first acute corner, the vertical and diagonal legs are contiguous and are connected by a second bendable section to define a second acute corner and the vertical and horizontal legs are interconnected to define a third corner. The bracket assembly also includes a lower bracket arm captured at the second corner by at least one surface irregularity and a bolt captured at the first corner by at least one surface irregularity as the angle bracket is formed into its load-bearing shape. In one embodiment of the present invention, the bracket assembly further includes an extension assembly attached to the angle bracket at the first acute corner. The extension assembly is pivotally mounted on the angle bracket so as to increase the overall size of the surface on which a horizontal plank can be placed to create a scaffold.

27 Claims, 11 Drawing Sheets

BRACKET ASSEMBLY

CROSS-REFERENCE TO RELATED APPLICATIONS

This application claims the benefit of U.S. patent application Ser. No. 08/823,226, which was filed on Mar. 24, 1997.

BACKGROUND OF THE INVENTION

The present invention relates generally to bracket assemblies for heavy loads. Angle brackets and bracket assemblies designed for heavy loads are well known in the art.

Angle brackets often comprise three main structural components, a horizontal, a diagonal and a vertical leg, which are interconnected so as to define, in load-bearing shape, a substantially triangular bracket. Bracket assemblies typically comprise an angle bracket of the type described above which is further attached to other members, such as an upper bracket arm and a lower bracket arm. An example of such a bracket assembly is disclosed in U.S. Pat. No. 2,342,427 to Riblet which is incorporated herein by reference. In U.S. Pat. No. 2,342,427, a lower bracket arm is shown attached to an angle bracket by a bolt which passes through a preformed hole in both the vertical leg and the diagonal leg.

In use, angle brackets and bracket assemblies are often mounted onto different surfaces to create various support structures.

For example, it is well known in the art to mount a pair of angle brackets directly onto a flat wall surface to create a shelf. A shelf is created by placing a horizontal plank across the pair of angle brackets. In this application, the vertical leg of each angle bracket is often provided with upper and lower keyslots or even the vertical leg may be replaced by the wall with out loss of strength. The keyslots can accommodate screws, nails or the like which extend through the angle bracket and into the wall surface to securely mount the angle bracket onto the wall surface.

It is also well known in the art to mount each of a pair of bracket assemblies onto an associated upright, such as a post or beam, to create a scaffold. A scaffold is created by securing the bracket arms of each bracket assembly onto its associated upright. A horizontal plank is then placed across the angle bracket of each bracket assembly to form the scaffold. In one application, each bracket assembly can be repositioned at varying heights along its associated upright to adjust the height of the scaffold.

In the art, angle brackets typically fall into two categories: one-piece angle brackets and multiple-piece angle brackets.

One-piece angle brackets include two or three legs which are formed from a single piece of material and which are interconnected so as to define a triangular bracket, the mounting surface being considered to be the third leg for one-piece angle brackets having two legs. For example, it is well known in the art for an angle bracket which can be used for shelving and other light loads to be formed entirely from a single sheet metal blank, one or more legs of the angle bracket being strengthened by longitudinal folding in the metal blank.

Multiple-piece angle brackets typically comprise two or three separate legs, as well as additional fastening components, which are interconnected so as to define a triangular bracket. U.S. Pat. No. 4,360,181 to Burkholder is a example of a multiple-piece angle bracket in which the vertical member of the angle bracket is a section of an extended upright. Multiple-piece angle brackets commonly comprise a plurality of structurally strong legs and a plurality of connecting means which may include nuts, bolts, rods and pins all interconnected to define, often with an additional vertical member, a triangular bracket. Due to the multitude of parts required, multiple piece angle brackets are more costly to manufacture and assemble than one-piece angle brackets.

Compared to one-piece angle brackets, however, it should be noted that the permissible strength of the parts included in multiple-piece angle brackets increase the overall strength of the angle bracket. In particular, it has been found that when compared with one-piece angle brackets, multiple piece angle brackets are considerably stronger at corners, each corner corresponding to the juncture of adjoining legs. As a consequence, multiple piece angle brackets are used for scaffolding and other heavy loads because they are capable of withstanding greater amounts of force than one-piece angle brackets.

In U.S. Pat. No. 5,257,766 to Riblet, which is incorporated herein by reference, there is disclosed an angle bracket constructed from a single piece metal blank. The bracket is of a substantially triangular shape. In one embodiment of the invention, the bracket has legs of U-shaped cross-section for strength. A method is disclosed for constructing the bracket from the metal blank which includes the steps of folding the metal blank along transverse fold lines to form its triangular shape. The method also includes the steps of folding the metal blank along longitudinal fold lines to form its U-shaped cross-section.

One-piece angle brackets, in which the bendable interconnections are strengthened by interlocking mechanical irregularities, tabs and slots for example, as described in U.S. Pat. No. 5,257,766 to Riblet, are extremely desirable since they combine the simplicity of the construction of one-piece angle brackets with the strength of the multiple-piece angle brackets. The simplicity of its construction results in substantial cost savings due to the need for less inventory control and greater ease in manufacture and assembly.

Angle brackets constitute the major component of bracket assemblies. Specifically, bracket assemblies comprise an angle bracket with additional parts attached to the corners of the angle bracket between the diagonal leg and the horizontal leg and the vertical leg, if present. In U.S. Pat. No. 2,854,293, a bracket assembly is disclosed in which a lower bracket arm is attached to the intersection between the diagonal and vertical legs of an angle bracket by a bolt. The bolt attaching the diagonal leg to the horizontal leg could also be used to attach an extension arm to the horizontal leg. Either or both of these arrangements are considered bracket assemblies.

Although the specifications and claims define an angle bracket as having a horizontal, a diagonal and a vertical leg, it should be stated that the features of the this invention are contained in the elements meeting at the intersection of the horizontal and diagonal legs. The vertical leg is included to simplify the figures and claims.

SUMMARY OF THE INVENTION

It is an object of the present invention to provide a new and improved bracket assembly.

It is another object of the present invention to provide a bracket assembly of the type described above which comprises a one-piece angle bracket.

It is yet another object of the present invention to provide a bracket assembly of the type described above which comprises an angle bracket formed from a single piece metal blank.

It is still another object of the present invention to provide a bracket assembly of the type described above which is strong and is constructed to withstand high levels of force.

It is yet another object of the present invention to provide a bracket assembly of the type described above which can be used to support a horizontal plank to form a scaffold.

It is still another object of the present invention to provide a bracket assembly of the type described above which can be used to support horizontal planks of varying widths.

It is another object of the present invention to provide a bracket assembly of the type described above which is easy to manufacture, has a limited number of parts, and which is easy to use.

Accordingly, there is provided a bracket assembly comprising an angle bracket formed from a single-piece metal blank, shaped and bent to define, in its load-bearing form, a substantially triangular bracket having horizontal and diagonal legs, the horizontal and diagonal legs being contiguous and connected by a first bendable section to define a first acute corner, the diagonal and vertical legs being contiguous and connected by a second bendable section to define a second acute corner and vertical and horizontal legs being interconnected to define a third corner, a first member coupled to said angle bracket at one of said acute corners, said first member being captured by at least one surface irregularity at said acute corner when the angle bracket is formed into its load-bearing shape, and an extension assembly coupled to said angle bracket at the first acute corner.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration of various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like-reference numerals represent like parts.

DETAILED DESCRIPTION OF A PREFERRED EMBODIMENT

Figure 1:
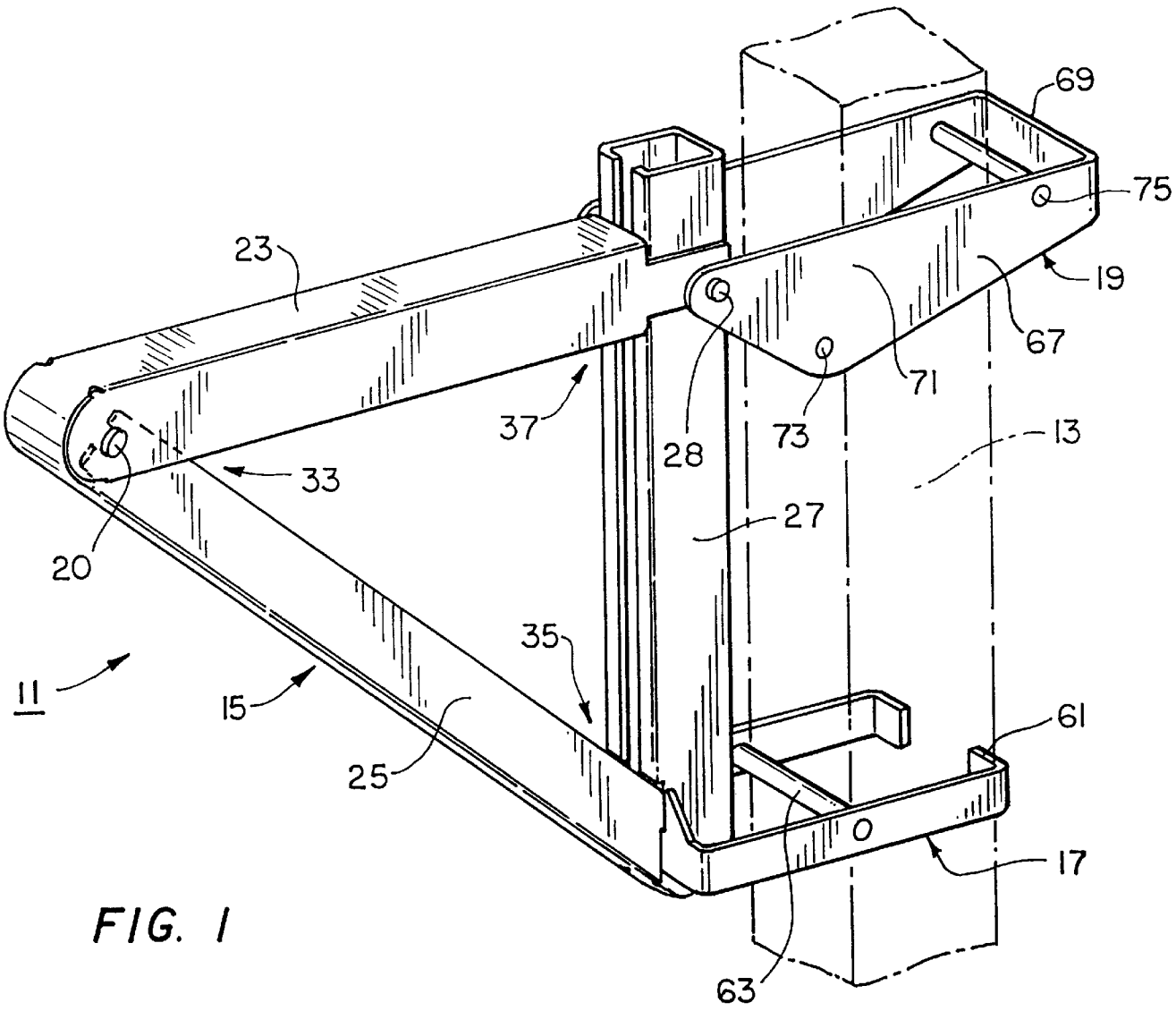
FIG. 1 is a perspective view of a first embodiment of a bracket assembly constructed according to the teachings of the present invention, the bracket assembly being shown mounted on an upright.

Referring now to FIG. 1, there is shown a perspective view of a bracket assembly constructed according to the teachings of the present invention, the bracket assembly being represented generally by reference numeral 11. Bracket assembly 11 is shown mounted on an upright 13 shown in phantom, upright 13 representing an object such as a beam or pole.

Bracket assembly 11 comprises an angle bracket 15, a lower bracket arm 17, an upper bracket arm 19 and a grooved anchoring bolt 20. Bracket arms 17 and 19 cooperate to mount angle bracket 15 onto upright 13. In this manner, a pair of bracket assemblies 11 can be used to create a scaffold. Specifically, with each of the pair of bracket assemblies mounted onto an associated upright, a scaffold is created by placing a plank across each angle bracket of the pair of bracket assemblies.

Figure 2:
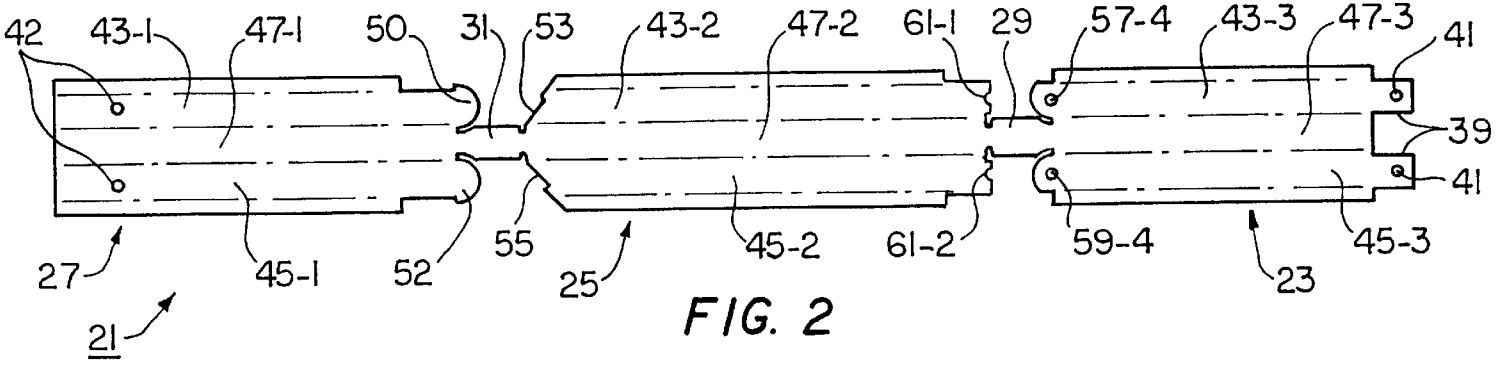
FIG. 2 is top plan view of the metal blank of the angle bracket shown in FIG. 1.
Figure 3:
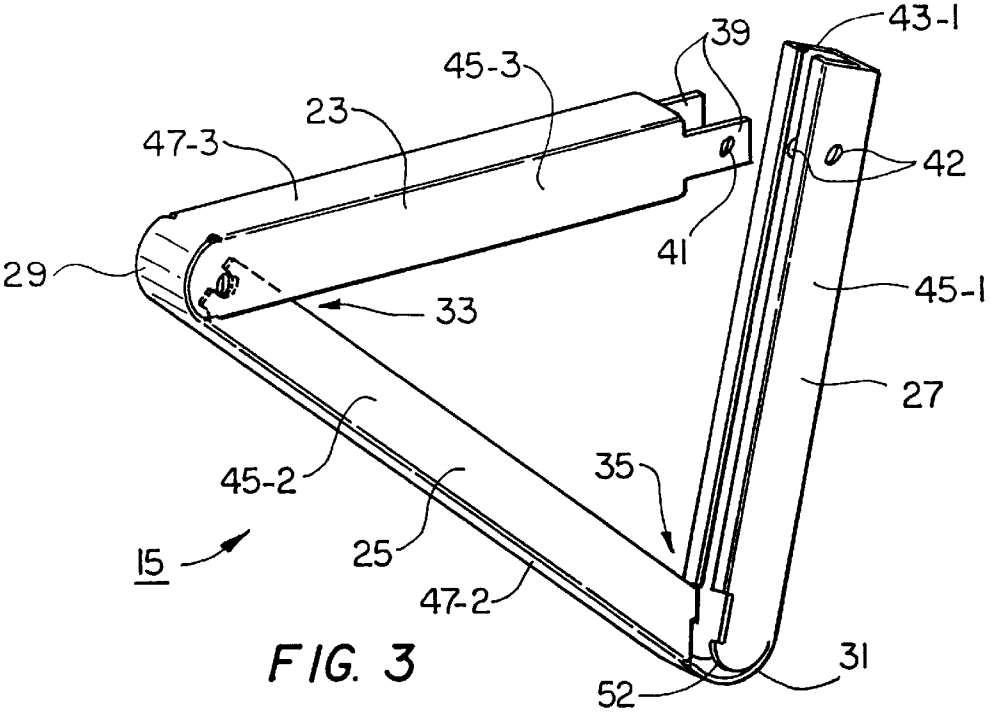
FIG. 3 is a perspective view of the metal blank shown in FIG. 2, the metal blank being shown partially folded into its final form.

Referring to FIG. 2, there is shown a top plan view of a metal blank 21. Metal blank 21 is shaped and bent in a series of steps, as shown in FIG. 3, so as to define angle bracket 15. Angle bracket 15 is a substantially triangular bracket comprising a horizontal leg 23, a diagonal leg 25 and a vertical leg 27. Horizontal leg 23 and diagonal leg 25 are contiguous and connect at a first bendable section 29. Diagonal leg 25 and vertical leg 27 are contiguous and connect at a second bendable section 31. Metal blank 21 is shaped and bent so that horizontal leg 23 and vertical leg 27 interconnect to form angle bracket 15, angle bracket 15 having a first acute corner 33, a second acute corner 35 and a square corner 37.

Metal blank 21 includes a pair of tabs 39, each tab 39 having a hole 41 formed therein. Holes 41 align with a pair of holes 42 formed in vertical leg 27 as metal blank 21 is shaped and bent into its load-bearing shape to form angle bracket 13. Tabs 39 are sized and shaped to pass along the outer surface of a pair of upstanding walls (to be described in detail below) on vertical leg 27 so that a bolt 28 in upper bracket arm 19 may be passed through holes 41 and 42, thereby ensuring that angle bracket 15 maintains its triangular, load-bearing shape. It should be noted that bracket assembly 11 is not limited to tabs, holes and a bolt to establish the interconnection of legs 23 and 27. Alternatively, tabs 39, holes 41 and 42 and bolt 28 could be replaced by other types of interconnecting means.

Vertical leg 27 includes a pair of upstanding sidewalls 43-1 and 45-1 which extend normally from a base 47-1 to create a substantially U-shaped cross section. Similarly, diagonal leg 25 includes a pair of upstanding sidewalls 43-2 and 45-2 which extend normally from a base 47-2 to create a substantially U-shaped cross-section. Horizontal leg 23 also includes a pair of upstanding sidewalls 43-3 and 45-3 which extend normally from a base 47-3 to create a substantially U-shaped cross-section. Upstanding sidewalls 43 and 45 in legs 23, 25 and 27 all extend normally from base 47 inward towards the center of angle bracket 13. Upstanding sidewalls 43-2 and 45-2 of diagonal leg 25 and upstanding sidewalls 43-3 and 45-3 of horizontal leg 23 overlap. Similarly, upstanding sidewalls 43-1 and 45-1 of vertical leg 27 and upstanding sidewalls 43-3 and 45-3 of horizontal leg 23 overlap.

Figure 4:
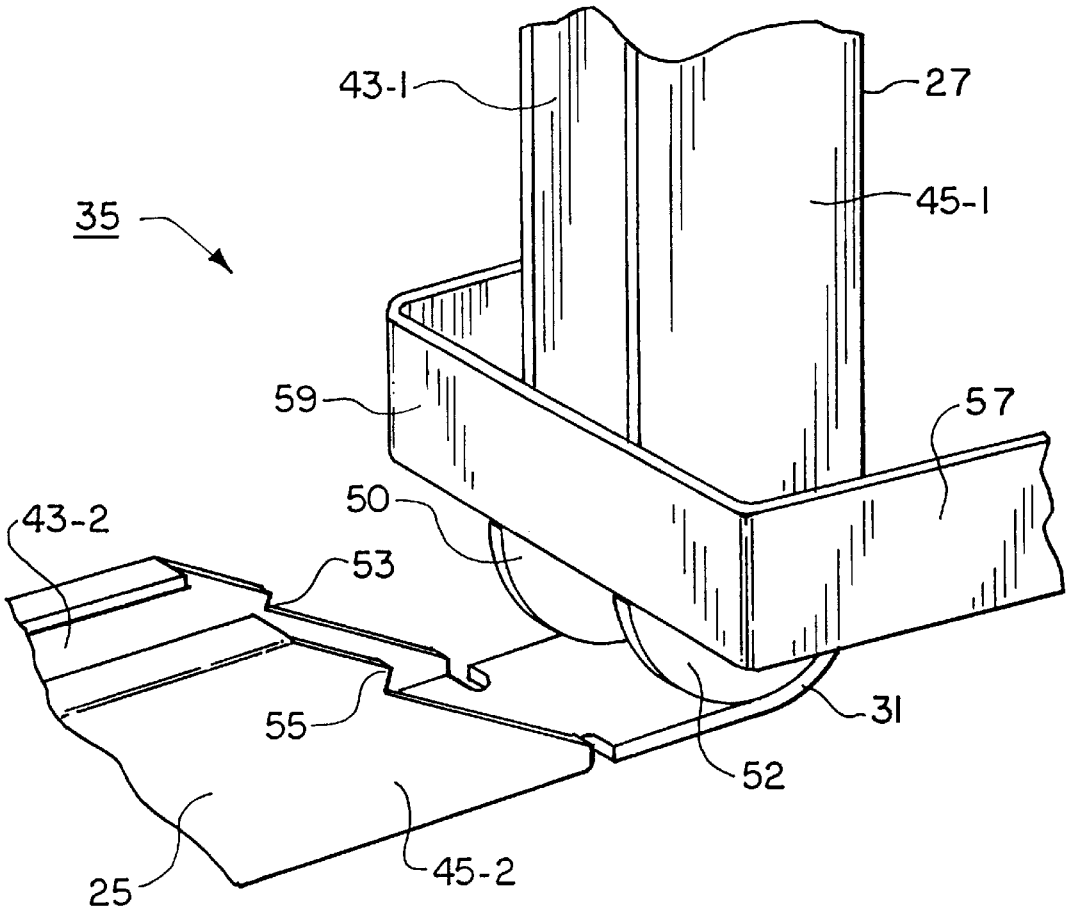
FIG. 4 is an enlarged perspective view, broken away in part, of the second acute corner of the bracket assembly of FIG. 1, the second acute corner being shown partially folded into its final form with the lower bracket arm positioned between the vertical leg and the diagonal leg.
Figure 5:
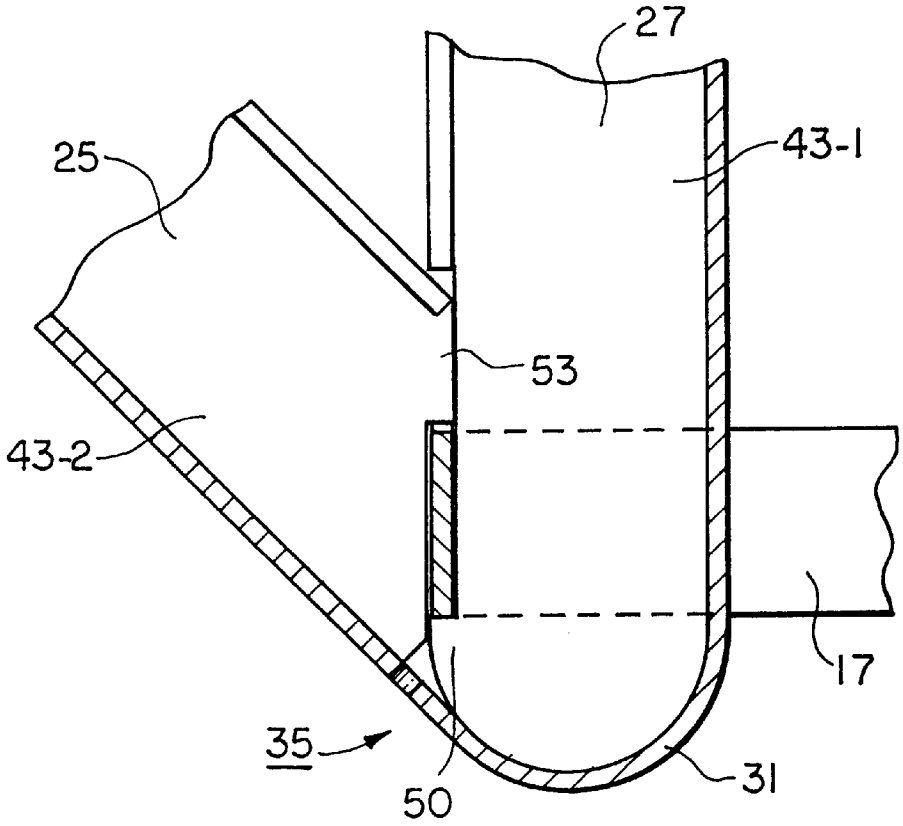
FIG. 5 is an enlarged side section view, broken away in part, of the second acute corer of the bracket assembly shown in FIG. 1, the second acute corner being shown positioned between the vertical leg and the diagonal leg.
Figure 6:
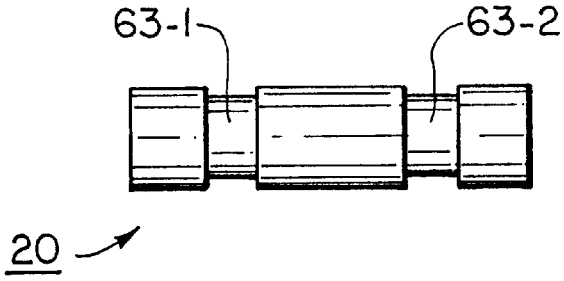
FIG. 6 is an enlarged front plan view of the grooved bolt shown in FIG. 1.
Figure 7:
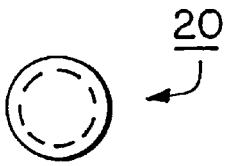
FIG. 7 is an end view of the bolt shown in FIG. 6.
Figure 8:
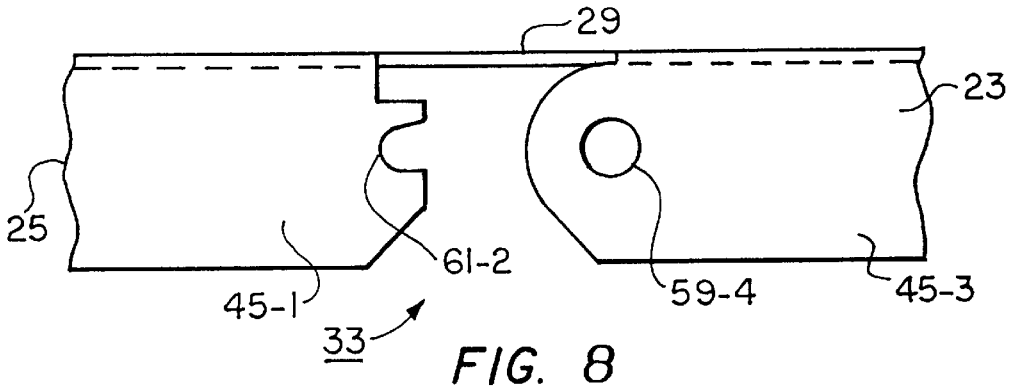
FIG. 8 is a side view, broken away in part, of the first acute corner of the angle bracket shown in FIG. 1, the first acute corner being shown partially bent along longitudinal lines into its final form.
Figure 9:
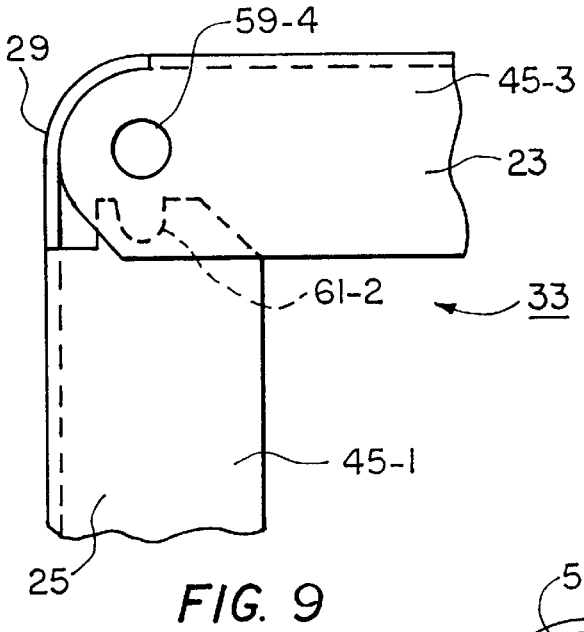
FIG. 9 is a side view, broken away in part, of the first acute corner of the angle bracket shown in FIG. 1, the first acute being shown partially folded into its final form.
Figure 10:
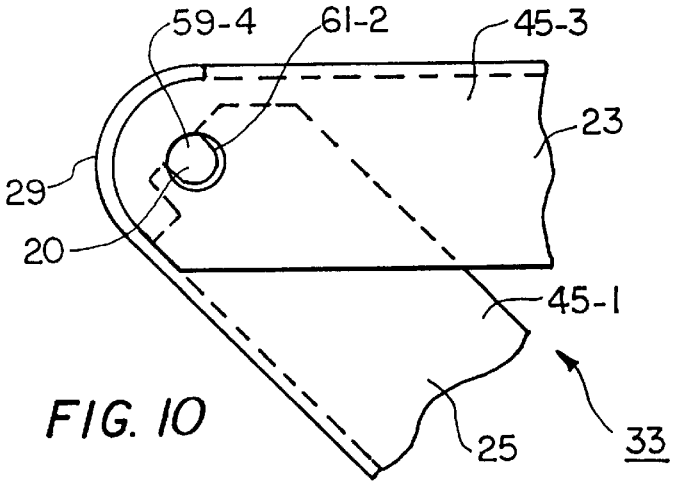
FIG. 10 is a side view, broken away in part, of the first acute corner of the bracket assembly shown in FIG. 1, the first acute corner being shown folded into its final form with the grooved bolt captured between the horizontal and diagonal legs.

Referring now to FIGS. 4 and 5, there are shown enlarged perspective and side views, respectively, of second acute corner 35 of bracket assembly 11. As can be seen, vertical leg 27 includes a surface irregularity in the form of a pair of shoulders 50 and 52. Shoulders 50 and 52 are positioned on upstanding sidewalls 43-1 and 45-1, respectively, of vertical leg 27. In addition, diagonal leg 25 includes a surface irregularity in the form of a pair of shoulders 53 and 55. Shoulders 53 and 55 are positioned on upstanding sidewalls 43-2 and 45-2, respectively, of diagonal leg 25. Shoulders 50 and 52 and shoulders 53 and 55 are disposed on opposing sides of and in close proximity to second bendable section 31.

Lower bracket arm 17 comprises a generally U-shaped band 57 having a closed end 59 and a partially open end 61. Lower bracket arm 17 further includes a separator 63. Partially open end 61 and separator 63 cooperate to engage opposing sides of upright 13.

As shown in FIG. 5, closed end 59 of lower bracket arm 17 is coupled to angle bracket 15 at second acute corner 35, closed end 59 being positioned within vertical leg 27 and diagonal leg 25. Closed end 59 is sized and shaped so as to rest on shoulders 50 and 52. As metal blank 21 is bent into its load bearing shape to form angle bracket 15, shoulders 53 and 55 lockingly engage from above closed end 59 of lower bracket arm 17, thereby securing lower bracket arm 17 in place. As can be appreciated, leg 25 is limited in its movement downward because shoulders 53 and 55 directly contact lower bracket arm 17. In turn, lower bracket arm 17 is restrained from moving downward by shoulders 50 and 52 on vertical leg 27. As such, a load on horizontal leg 23 will not unbend second bendable section 31. Rather, a load on horizontal leg 23 is shunted around second bendable section 31, through lower bracket arm 17 and directly to vertical leg 27.

Referring now to FIGS. 6 through 10, bolt 20 serves a similar function in shunting a vertical load on horizontal leg 23 for first acute corner 33 as lower bracket arm 17 served for second acute corner 35. Specifically, surface irregularities in the form of holes 57-4 and 59-4 are provided in horizontal side walls 43-3 and 45-3, respectively, of horizontal leg 23, through which grooved bolt 20 may be inserted. Additional surface irregularities in the form of semi-circular notches 61-1 and 61-2 are provided in the diagonal side walls 43-2 and 45-2, respectively, of diagonal leg 25. Notches 61-1 and 61-2 are dimemsioned to engage the grooves 63-1 and 63-2 of bolt 20 when first bendable section 29 between horizontal leg 23 and diagonal leg 25 has been formed into its load-bearing shape. As can be appreciated, a vertical load on horizontal arm 23 is prevented from unbending first bendable section 29 because the downward force exerted on first bendable section 29 is transferred to bolt 20, holes 57-4 and 59-4 in horizontal arm 23 and then to semi-circular notches 61-1 and 61-2 in diagonal sidewalls 43-2 and 45-2 of diagonal leg 25.

Upper bracket arm 19 is a conventional load activated lock which supports angle bracket 15 on upright 13, upper bracket arm being any type of load activated lock which is well known in the art, such as U.S. Pat. No. 2,342,427 to Riblet. Upper bracket arm 19 comprises a generally U-shaped member 67 having a closed end 69 and an open end 71. Upper bracket arm 19 further includes an inner jaw 73 and an outer jaw 75 which engage opposing sides of upright 13. Inner jaw 73 and outer jaw 75 of upper bracket arm 19 and partially open end 61 and separator 63 of lower bracket arm 17 together cooperate to enable bracket assembly 11 to be mounted onto upright 13. Upper bracket arm 19 further comprises bolt 28 which is coupled to angle bracket 15 at square corner 37. Bolt 28 serves as a fulcrum point about which upper bracket arm 19 is free to rotate.

FIGS. 11 through 16, disclose of three modifications of first acute corner 33, the three modifications being identified generally as first acute corners 133, 233 and 333, respectively. The three modifications illustrate the fact that there are many equivalent ways in which surface irregularities in either or both diagonal leg 15 and horizontal leg 23 may capture a second member, such as a bolt, while first bendable section 29 is being formed into its load-bearing shape, the second member which may or may not serve to shunt some or all of the force applied on first bendable section when a vertical load is applied to horizontal leg 23.

Figure 11:
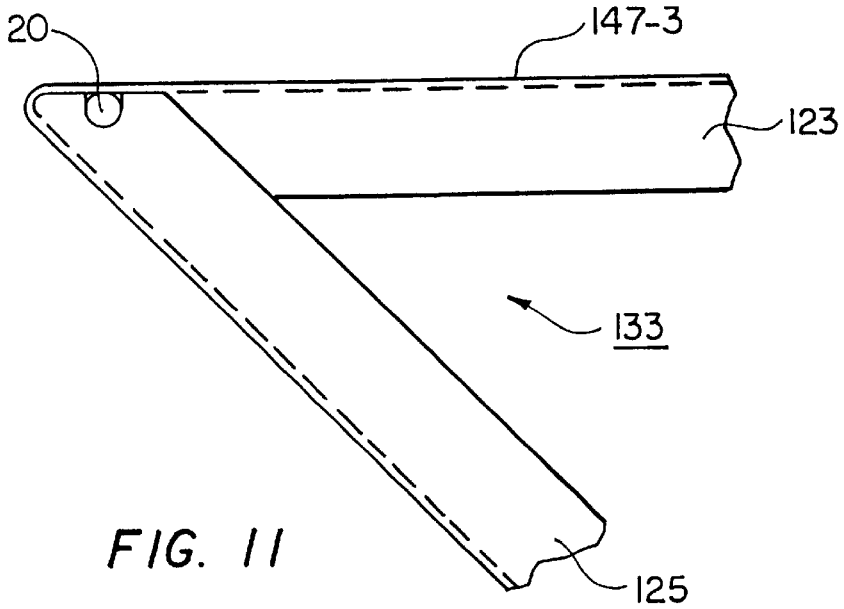
FIG. 11 is a side view, broken away in part, of a first modification of the first acute corner of the angle-bracket shown in FIG. 1, the first acute corner being shown folded into its final form with the grooved bolt captured between the horizontal and diagonal legs.
Figure 12:
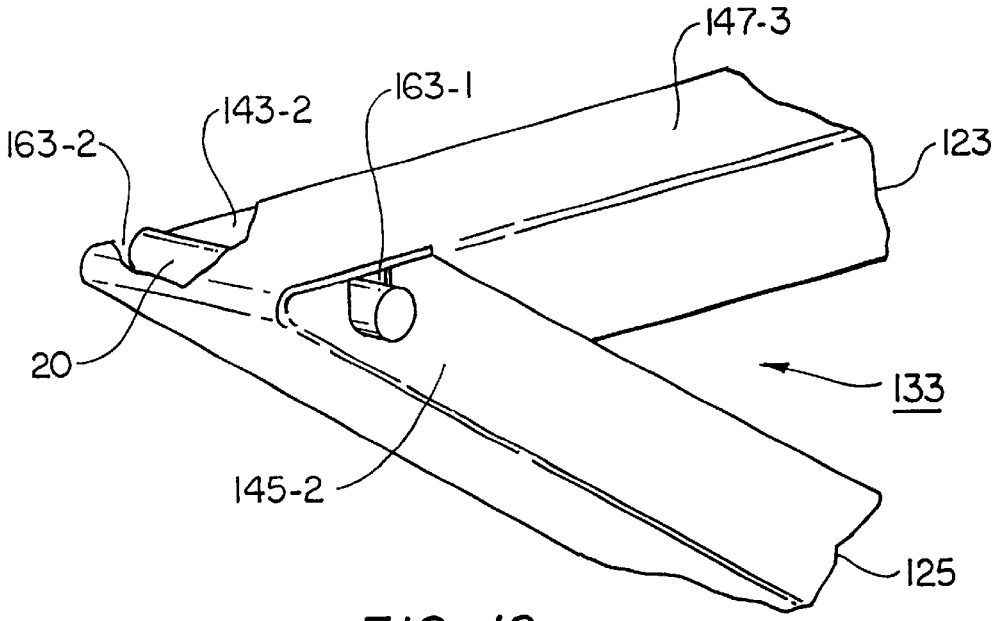
FIG. 12 is a perspective section view, broken away in part, of the first acute corner shown in FIG. 11.

Referring now to FIGS. 11 and 12, in one modification, first acute corner 133 is shown with bolt 20 captured between a pair of grooves 163-1 and 163-2 formed in diagonal side walls 145-2 and 143-2, respectively, of diagonal leg 125 and the lower surface of horizontal base 147-3 of horizontal leg 123. It should be noted that grooves 163-1 and 163-2 do not engage horizontal base 147-3 but rather grooves 163-1 and 163-2 serve to support bolt 20 in place.

Figure 13:
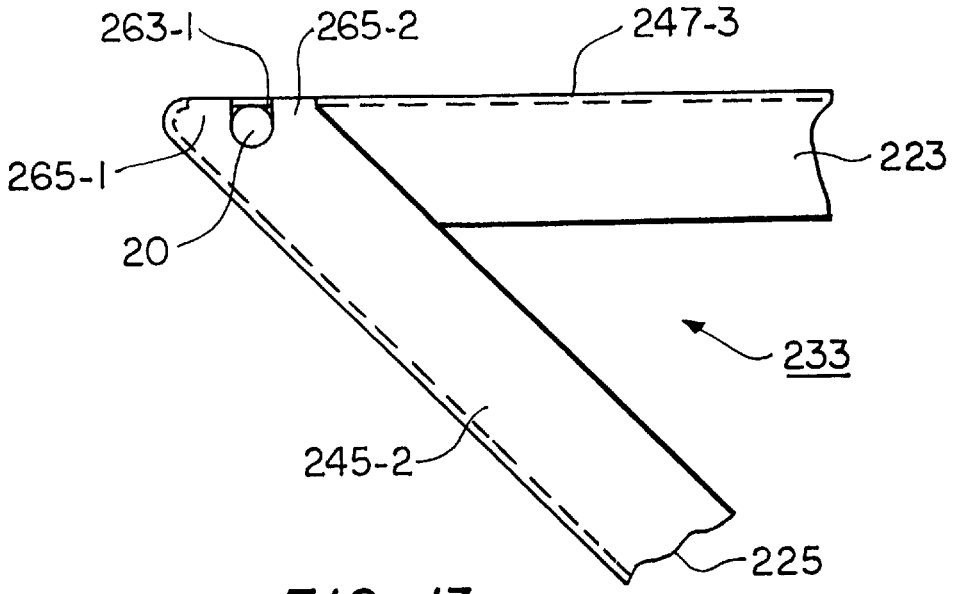
FIG. 13 is a side view, broken away in part, of a second modification of the first acute corner of the angle bracket shown in FIG. 1, the first acute corner being shown folded into its final form with the grooved bolt captured between the horizontal and diagonal legs and with tabs in the diagonal leg interlocking with slots in the horizontal leg.
Figure 14:
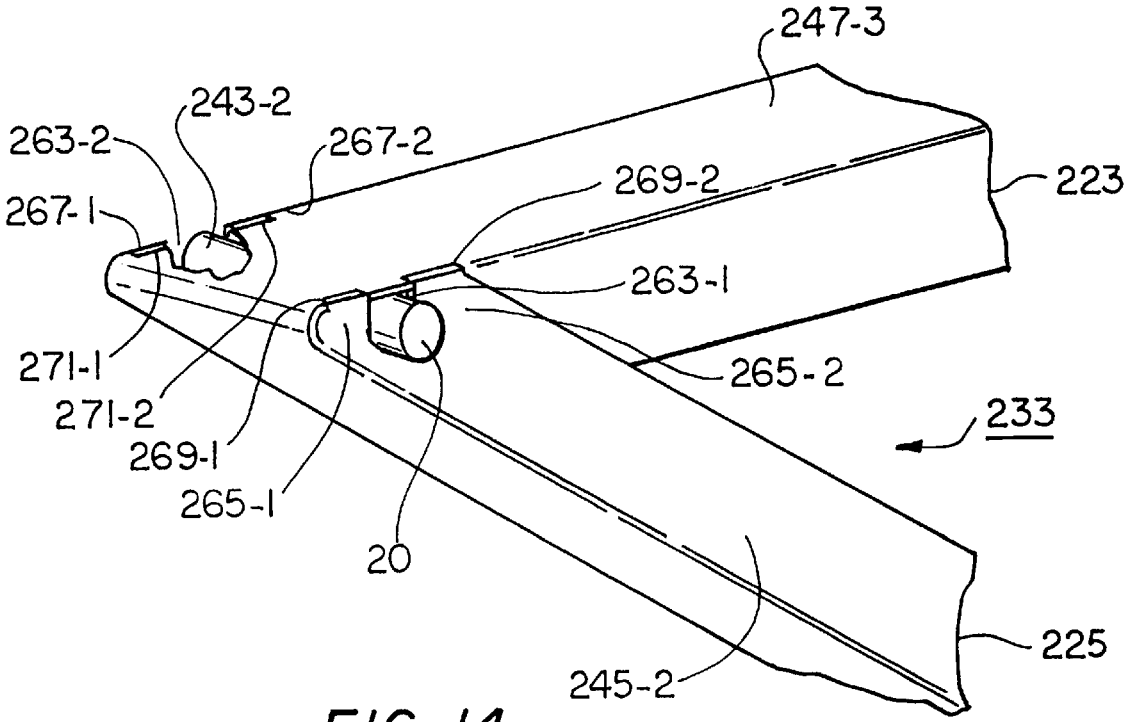
FIG. 14 is a perspective section view, broken away in part, of the first acute corner shown in FIG. 13.

Referring now to FIGS. 13 and 14, in another modification, first acute corner 233 is shown with bolt 20 captured between a pair of grooves 263-1 and 263-2 formed in diagonal side walls 245-2 and 243-2, respectively, of diagonal leg 225 and the lower surface of horizontal base 247-3 of horizontal leg 223. Diagonal side wall 245-2 further includes a pair of tabs 265-1 and 265-2 and diagonal sidewall 243-2 further includes a pair of tabs 267-1 and 267-2. Tabs 265-1, 265-2, 267-1 and 267-2 engage a plurality of notches 269-1, 269-2, 271-1 and 271-2, respectively, formed in base 247-3 of horizontal leg 223 and, without bolt 20, prevent deformation of first bendable section 229 which could result from the introduction of a heavy vertical load on horizontal leg 223.

Figure 15:
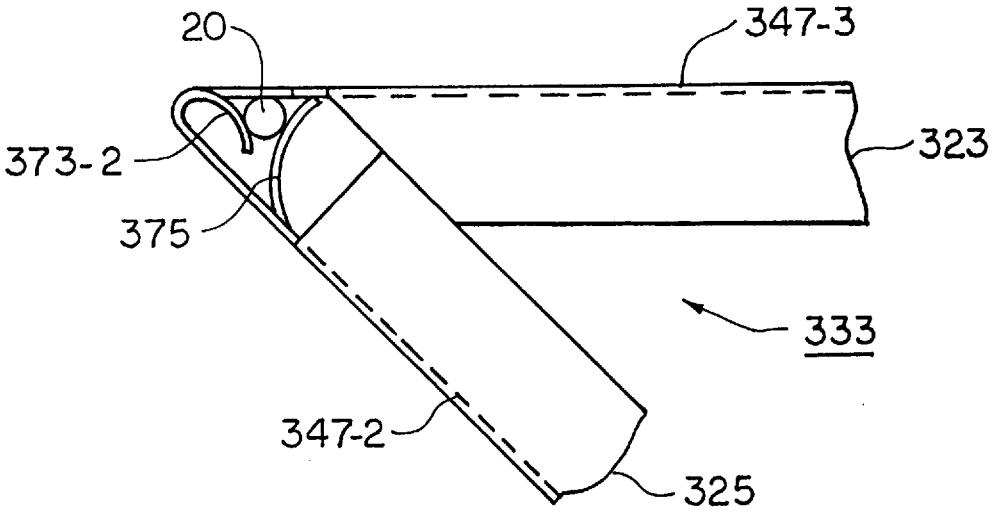
FIG. 15 is a side view, broken away in part, of a third modification of the first acute corner of the angle bracket shown in FIG. 1, the first acute corner being shown folded into its final form with the grooved bolt captured between the horizontal and diagonal legs.
Figure 16:
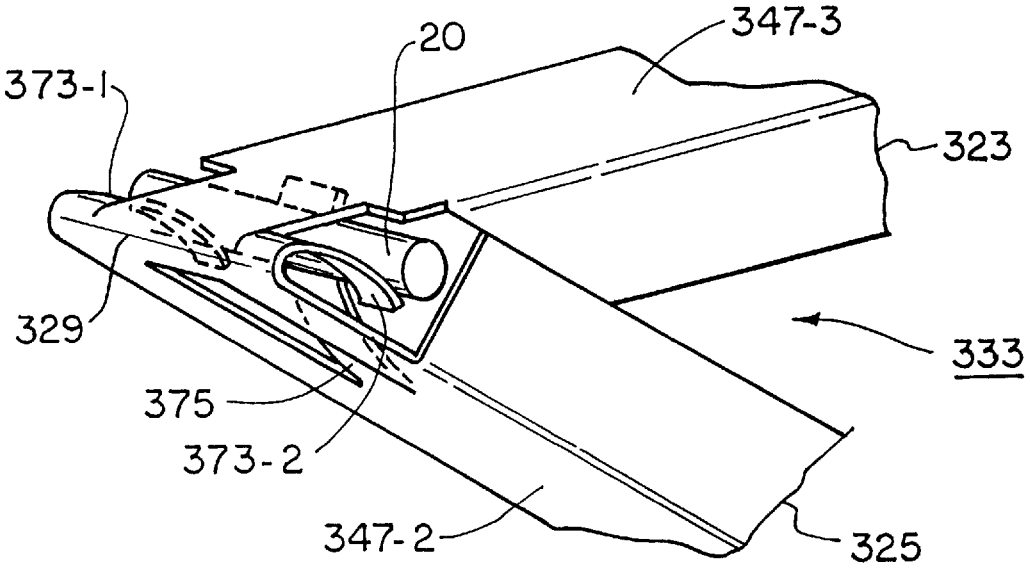
FIG. 16 is a perspective view, broken away in part, of the first acute corner shown in FIG. 15.

Referring now to FIGS. 15 and 16, in another modification, first acute corner 333 is shown with bolt 20 captured between a pair of curved tabs 373-1 and 373-2 formed in horizontal base 347-3 of horizontal leg 323 and a single curved tab 375 formed in diagonal base 347-2 of diagonal leg 325. As can be appreciated, forces that would unbend first bendable section 329 are shunted instead from horizontal leg 323 directly to diagonal leg 325, through bolt 20.

Figure 17:
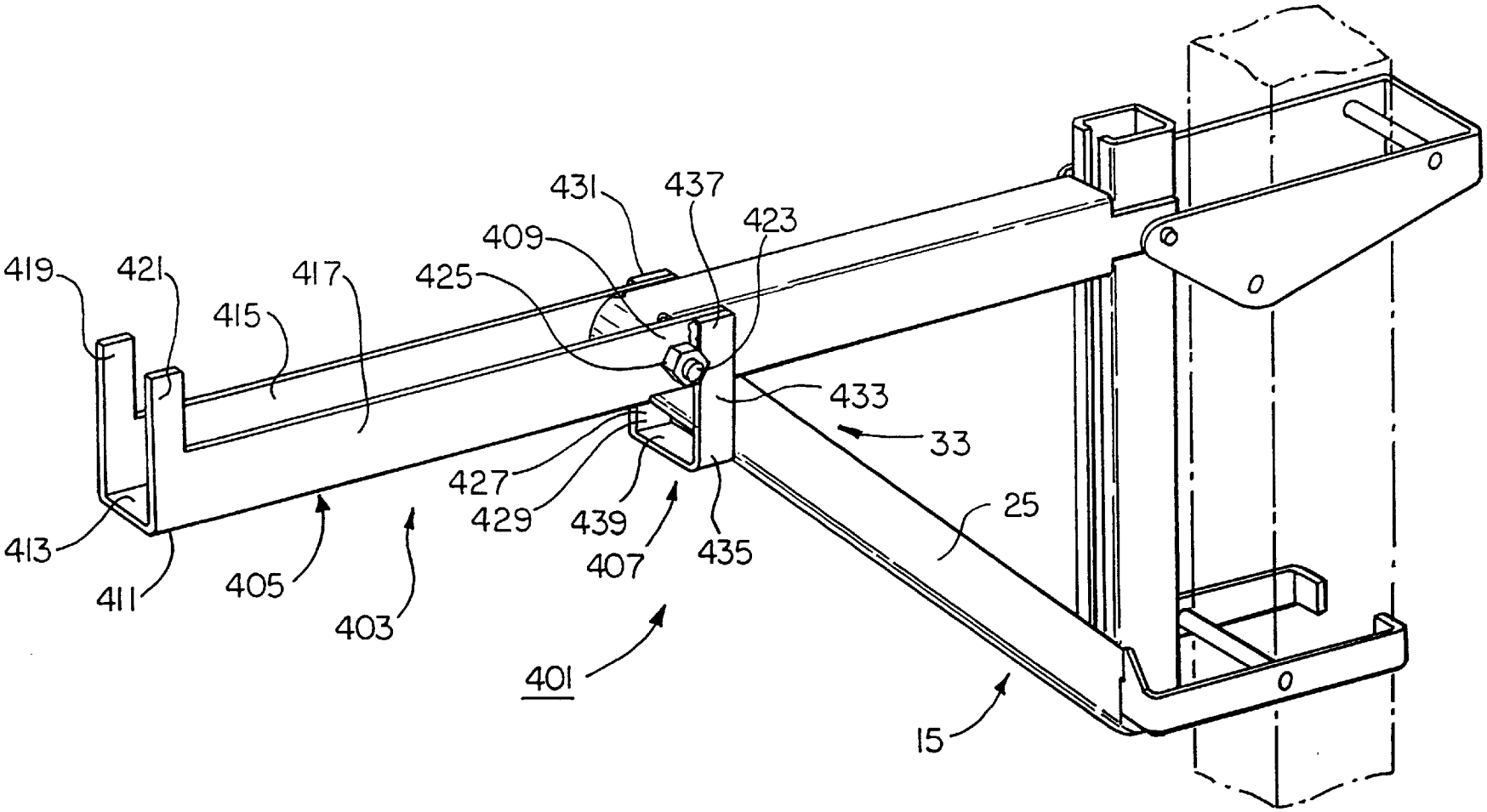
FIG. 17 is a perspective view of another embodiment of a bracket assembly constructed according to the teachings of the present invention, the bracket assembly being shown mounted on an upright.
Figure 18:
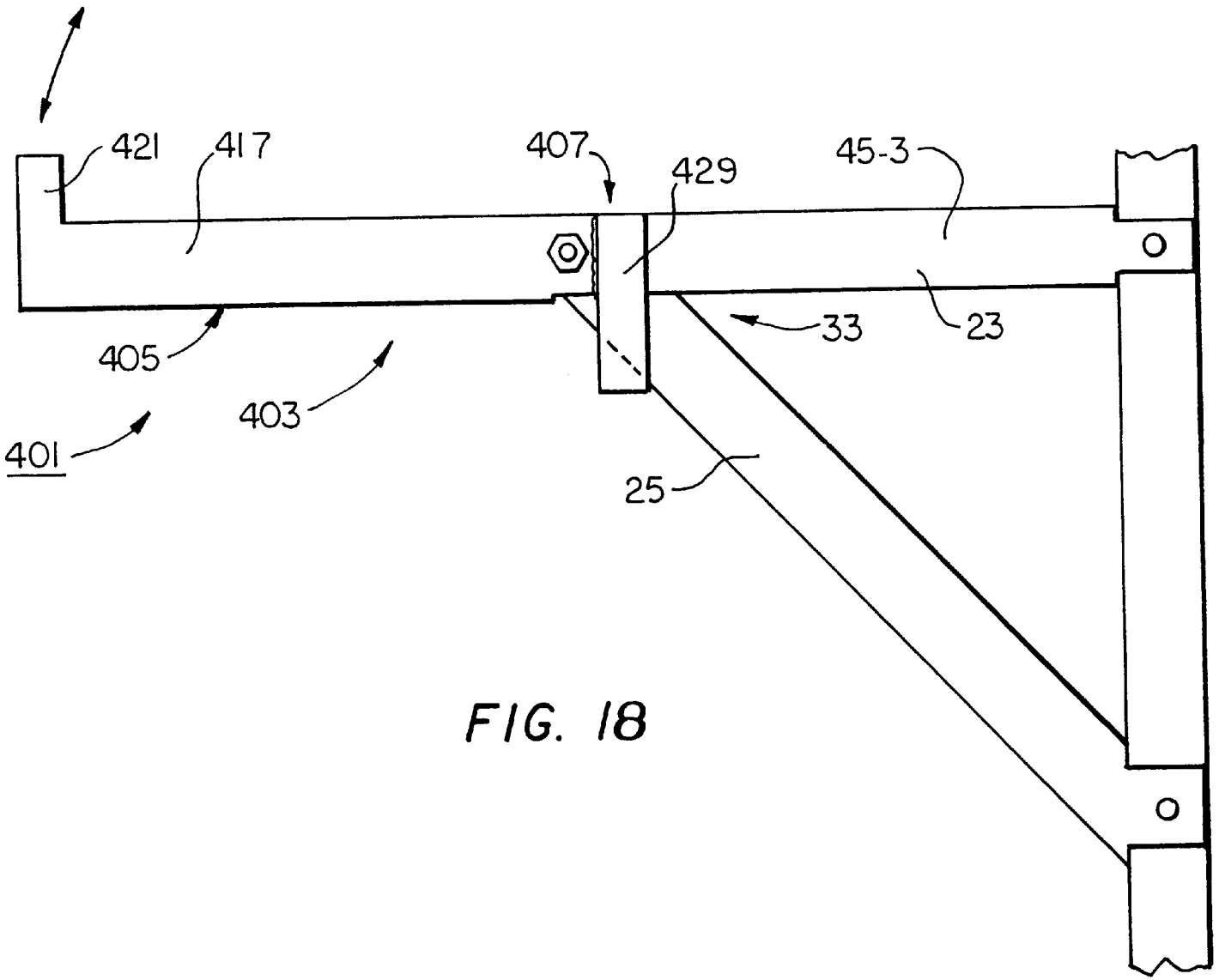
FIG. 18 is a side view, broken away in part, of the bracket assembly of FIG. 17, the bracket assembly being shown with the extension arm shown in a fully extended position.
Figure 19:
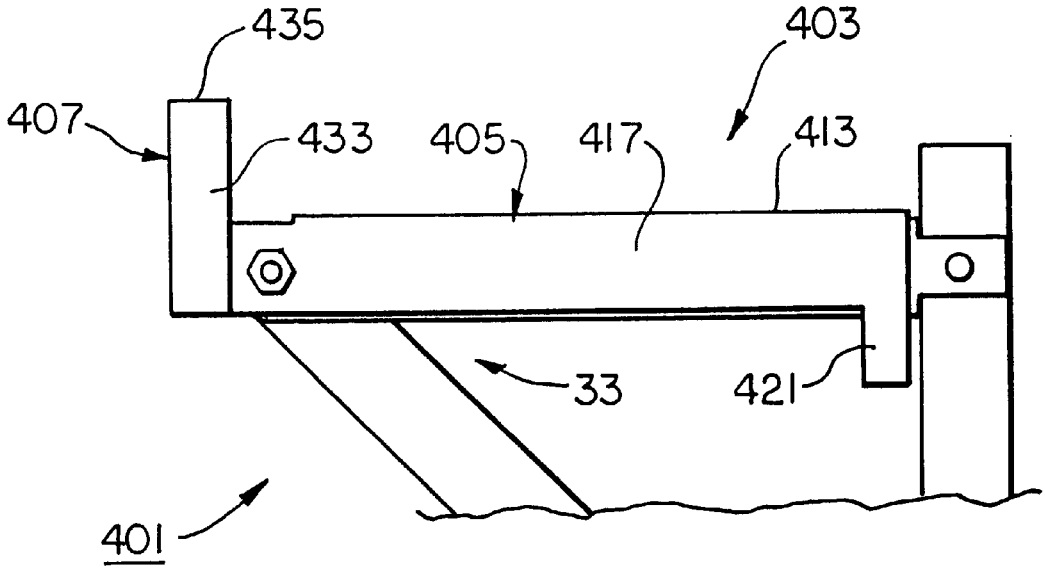
FIG. 19 is a side view, broken away in part, of the bracket assembly of FIG. 17, the bracket assembly being shown with the extension arm shown in a retracted position.

Referring now to FIGS. 17–19, there is shown another embodiment of a bracket assembly constructed according to the teachings of the present invention, the bracket assembly being represented generally by reference numeral 401. Bracket assembly 401 is similar in form to bracket assembly 11 in having horizontal and vertical legs except bracket assembly 401 additionally comprises an extension assembly 403 attached to angle bracket 15 at first acute corner 33. As will be described further in detail below, extension assembly 403 serves to increase the overall size of the surface on which a horizontal plank can be placed to create a scaffold.

Extension assembly 403 comprises an extension arm 405 and a stop member 407 which are welded together to form a single piece. It is to be understood, that extension arm 405 and stop member 407 could be formed either as a single integral piece or as two separate pieces without departing from the spirit of the present invention.

Extension arm 405 is a generally L-shaped member constructed of a strong and durable material, such as metal, and includes a first end 409 and a second end 411. Extension arm 405 is generally U-shaped in cross-section and comprises a flat end surface 413 and a pair of outwardly extending sidewalls 415 and 417 which project perpendicularly from flat end surface 413. Each of outwardly extending sidewalls 415 and 417 are shaped to include a raised heel 419 and 421, respectively, at second end 411. As will be described further in detail below, raised heels 419 and 421 provide an abutment for preventing a plank from slipping off bracket assembly 401.

Extension arm 405 further comprises a pair of openings (not shown) formed in outwardly extending sidewalls 415 and 417, respectively, at first end 409. Extension arm 405 is pivotally mounted on angle bracket 15 at first acute corner 33 so that the openings formed in extension arm 405 are in alignment with holes 57-4 and 59-4 of horizontal leg 23. With extension arm 405 positioned as such, the openings are sized and shaped to enable a threaded bolt 423 and nut 425 to be passed therethrough to secure extension assembly 403 onto angle bracket 15. It should be noted that bracket assembly 401 is not limited to the use of threaded bolt 423 and nut 425 to secure extension assembly 403 onto angle bracket 15. Rather, bracket assembly 401 could use any alternate attachment means, such as bolt 20, to secure extension assembly 403 onto angle bracket 15 without departing from the spirit of the present invention.

Stop member 407 is a one-piece, generally U-shaped member constructed of a strong and durable material, such as metal, and comprises a first elongated sidewall 427 having a first end 429 and a second end 431, a second elongated sidewall 433 having a first end 435 and a second end 437, and an end wall 439 connecting first end 429 of sidewall 427 to first end 435 of sidewall 433. Stop member 407 is welded to first end 409 of extension arm 405 so that second ends 431 and 437 of sidewalls 427 and 433, respectively, contact the outer surface of outwardly extending sidewalls 415 and 417, respectively.

In use, extension assembly 403 is mounted on angle bracket 15 so as to pivot about first acute corner 33. Specifically, extension assembly 403 is mounted on angle bracket 15 so as to enable extension assembly 403 to be pivoted between an extended position, as shown in FIG. 18 and a retracted, or nested, position, as shown in FIG. 19.

With extension assembly 403 positioned in a retracted position as shown in FIG. 19, outwardly extending sidewalls 415 and 417 of extension arm 405 are positioned just outside of sidewalls 43-3 and 45-3, respectively, of horizontal leg 23, flat end surface 413 of extension arm 405 is positioned just above base 47-3 of horizontal leg 23, and raised heels 419 and 421 of extension arm 405 are positioned in parallel with vertical leg 27. Furthermore, stop member 407 is orientated such that first and second sidewalls 427 and 433 extend up perpendicularly relative to horizontal leg 23 of angle bracket 15. It should be noted that first end 429 of first sidewall 427 and first end 435 of second sidewall 433 are both sized and shaped to serve as an abutment surface for preventing a plank from slipping off bracket assembly 401.

As shown in FIG. 18, extension assembly 403 can be pivoted 180 degrees about first acute corner 33. With extension assembly 403 positioned in a extended position, outwardly extending sidewalls 415 and 417 of extension arm 405 extend out from first acute corner 33 in a collinear relation with horizontal leg 23. As such, raised heels 419 and 421 of extension arm 405 extend up perpendicularly relative to horizontal leg 23 of angle bracket 15 and serve as an abutment surface for preventing a plank from slipping off bracket assembly 401. In addition, it should be noted that, positioned as such, end wall 439 of stop member 407 abuts against diagonal leg 25, thereby precluding further overrotation of extension assembly 403 as well as reinforcing the strength of bracket assembly 401 about first corner 33.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A bracket assembly comprising:

(a) an angle bracket forming, in its load-bearing form, together with a vertical supporting member, a substantially triangular bracket having horizontal and diagonal legs, the diagonal and horizontal legs being contiguous and connected by a bolt to define an acute corner, (b) an extension arm having a first end and a second end, the first end of said extension arm being coupled to said angle bracket at said acute corner by said bolt, said extension arm being rotatable about said bolt from a first horizontal position to a second horizontal position, and (c) a stop member coupled to the first end of said extension arm, said stop member contacting the diagonal leg of said angle bracket when said extension arm is in one of said first and second horizontal positions and said stop member being positioned vertically when said extension arm is in the other of said first and second horizontal positions.

2. The bracket assembly as claimed in claim 1 wherein said angle bracket is formed from a single-piece metal blank.

3. The bracket assembly as claimed in claim 2 wherein said bolt is captured by at least one surface irregularity at said acute corner when the angle bracket is formed into its load-bearing shape.

4. A bracket assembly comprising:

(a) an angle bracket formed from a single-piece metal blank, shaped and bent to define, in its load-bearing form, a substantially triangular bracket having vertical, diagonal and horizontal legs, the diagonal and horizontal legs being contiguous and connected by a first bendable section to define a first acute corner, the vertical and diagonal legs being contiguous and connected by a second bendable section to define a second acute corner and the vertical and horizontal legs being interconnected to define a third corner;

(b) a first member coupled to said angle bracket at one of said acute corners, said first member being captured by at least one surface irregularity at said acute corner when the angle bracket is formed into its load-bearing shape; and (c) an extension assembly coupled to said angle bracket at the first acute corner.

5. The bracket assembly as claimed in claim 4 wherein said extension assembly is pivotally coupled to said angle bracket at the first acute corner.

6. The bracket assembly as claimed in claim 5 wherein said extension assembly comprises an extension arm and a stop member.

7. The bracket assembly as claimed in claim 6 wherein said extension arm comprises a first end and a second end, said second end being generally L-shaped.

8. The bracket assembly as claimed in claim 7 wherein said extension arm is U-shaped in cross section.

9. The bracket assembly as claimed in claim 8 wherein said stop member comprises a first sidewall having a first end and a second end, a second sidewall having a first end and a second end, and an end wall connecting the first end of the first sidewall to the first end of the second sidewall.

10. The bracket assembly as claimed in claim 9 wherein said first member is a bolt captured at the first acute corner by the horizontal and diagonal legs of said angle bracket.

11. The bracket assembly as claimed in claim 10 wherein said extension assembly comprises at least one hole which is sized and shaped to enable said bolt to be passed therethrough to secure said extension assembly onto said angle bracket.

12. The bracket assembly as claimed in claim 11 wherein said bolt is captured by the at least one surface irregularity at the first acute corner to shunt around the first bendable section forces introduced by a heavy load placed on the horizontal leg of said angle bracket.

13. The bracket assembly as claimed in claim 12 wherein each of the vertical, diagonal and horizontal legs include a pair of upstanding sidewalls and a base which together form a substantially U-shaped cross-section.

14. The bracket assembly as claimed in claim 13 wherein the pair of upstanding walls of each leg extend normally from its associated base.

15. The bracket assembly as claimed in claim 14 wherein the pair of upstanding sidewalls of each leg extend normally from its associated base in the direction towards an approximate center of said angle bracket.

16. A bracket assembly comprising:

(a) an angle bracket forming, in its load-bearing form, together with a vertical supporting member, a substantially triangular bracket having horizontal and diagonal legs, the diagonal and horizontal legs being contiguous and connected to define a first acute corner whereat a bolt is captured, (b) an extension arm having a first end and a second end, the first end of said extension arm being coupled to said angle bracket at said acute corner by said bolt, said extension arm being rotatable about said bolt from a first horizontal position to a second horizontal position, and (c) a stop member at the first end of said extension arm, said stop member contacting the diagonal leg of said angle bracket when said extension arm is in one of said first and second horizontal positions and said stop member being positioned vertically when said extension arm is in the other of said first and second horizontal positions.

17. The bracket assembly as claimed in claim 16 wherein said angle bracket is formed from a single-piece metal blank.

18. The bracket assembly as claimed in claim 17 wherein said bolt is captured by at least one surface irregularity at said acute corner when the angle bracket is formed into its load-bearing shape.

19. The bracket assembly as claimed in claim 18 wherein the vertical supporting member is in the form of a vertical leg, the vertical leg and the diagonal leg being connected to define a second acute corner and the vertical and horizontal legs being interconnected to define a third corner.

20. A bracket assembly comprising:

(a) an angle bracket formed from a single-piece metal blank, shaped and bent to define, in its load-bearing form, a substantially triangular bracket having vertical, diagonal and horizontal legs, the diagonal and horizontal legs being contiguous and connected by a first bendable section to define a first acute corner, the vertical and diagonal legs being contiguous and connected by a second bendable section to define a second acute corner and the vertical and horizontal legs being interconnected to define a third corner;

(b) a bolt coupled to said angle bracket at the first acute corner, said bolt being captured by at least one surface irregularity at the first acute corner when the angle bracket is formed into its load-bearing shape; and (c) an extension arm coupled to said angle bracket at the first acute corner, said extension arm having a first end and a second end, the first end of said extension arm being coupled to said angle bracket at the first acute corner by said bolt, said extension arm being rotatable about said bolt from a first horizontal position to a second horizontal position, and (d) a stop member at the first end of said extension arm, said stop member contacting the diagonal leg of said angle bracket when said extension arm is in one of said first and second horizontal positions and said stop member being positioned vertically when said extension arm is in the other of said first and second horizontal positions.

21. The bracket assembly as claimed in claim 20 wherein each of the vertical, diagonal and horizontal legs include a pair of upstanding sidewalls and a base which together form a substantially U-shaped cross-section.

22. The bracket assembly as claimed in claim 21 wherein the pair of upstanding sidewalls of each leg extend normally from its associated base in the direction towards an approximate center of said angle bracket.

23. The bracket assembly as claimed in claim 20 wherein said extension member includes a pair of upstanding sidewalls and a base which together form a substantially U-shaped cross-section.

24. An extension assembly for an angle bracket having horizontal and diagonal legs, the diagonal and horizontal legs being connected to define an acute corner, said extension assembly comprising:

(a) an extension arm having a first end and a second end, the first end of said extension arm being adapted to be pivotally coupled to the angle bracket at the acute corner, said extension arm being adapted to be rotated about the acute corner from a first horizontal position to a second horizontal position, and (b) a stop member at the first end of said extension arm, said stop member projecting upwardly when said extension arm is in the first horizontal position and said stop member being adapted to abut the diagonal arm of the angle bracket when said extension arm is in the second horizontal position.

25. The extension assembly as claimed in claim 24 wherein said extension assembly is one piece.

26. The extension assembly as claimed in claim 24 wherein said extension arm is U-shaped in cross-section.

27. The extension assembly as claimed in claim 24 wherein said stop member comprises a first sidewall having a first end and a second end, a second sidewall having a first end and a second end, and an end wall connecting the first end of the first sidewall to the first end of the second sidewall.

* * * * *